US005091994A

United States Patent [19]

Delane et al.

[11] Patent Number: 5,091,994

[45] Date of Patent: Mar. 3, 1992

[54] THREE-WAY HAT

[76] Inventors: Louis A. Delane; Elsie M. Delane, both of P.O. Box 922589, Sylmar, Calif. 91342

[21] Appl. No.: 606,581

[22] Filed: Oct. 31, 1990

[51] Int. Cl.[5] ..... A42B 1/00

[52] U.S. Cl. ..... 2/195; 2/171; 2/177

[58] Field of Search ..... 2/171, 171.1, 171.2, 2/195, 196, 209.1, 209.3, 12, 15, 175, 177, 178, 209.4, 209.5, 209.7

[56] References Cited

U.S. PATENT DOCUMENTS

| | | | |
|---|---|---|---|
| 419,765 | 1/1890 | Frank | 2/171 |
| 606,982 | 7/1898 | Smyth | 2/171 |
| 1,648,551 | 11/1927 | Klein | 2/195 |
| 1,677,187 | 7/1928 | Leibson | 2/209.5 |
| 3,374,488 | 3/1968 | Erbb | 2/177 |
| 3,857,117 | 12/1974 | Tenowitz | 2/177 |

FOREIGN PATENT DOCUMENTS

| | | | |
|---|---|---|---|
| 1141102 | 2/1983 | Canada | 2/196 |
| 8117 | of 1884 | United Kingdom | 2/195 |
| 17570 | of 1893 | United Kingdom | 2/195 |

OTHER PUBLICATIONS

Advertisement, "Confused Leader Double-Brimmed Cap", 7/22/85.

*Primary Examiner*—Werner H. Schroeder
*Assistant Examiner*—Diana L. Biefeld
*Attorney, Agent, or Firm*—Allan M. Shapiro

[57] ABSTRACT

The three-way hat of this invention has a crown and in excess of two, preferably three, bills attached thereto. Above each bill on the adjacent crown there is a display segment and there is a unique message on each display segment. The unique message may be distinctive by way of color, texture, or configuration to uniquely display the message. Each bill is permanently attached to the adjacent display segment. The several display segments may be permanently or detachably attached.

13 Claims, 1 Drawing Sheet

FIG. 1
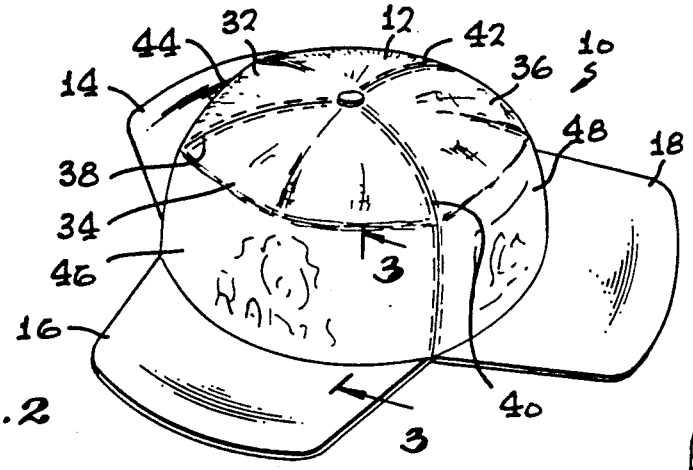
FIG. 2
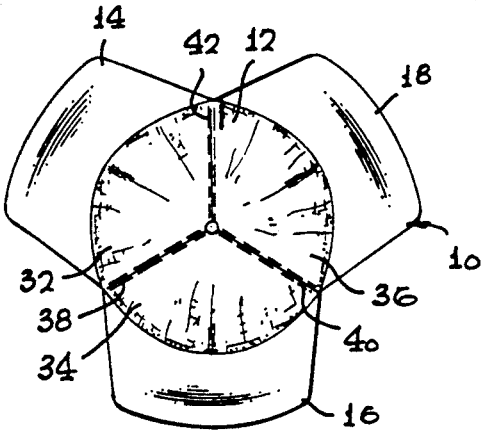
FIG. 3
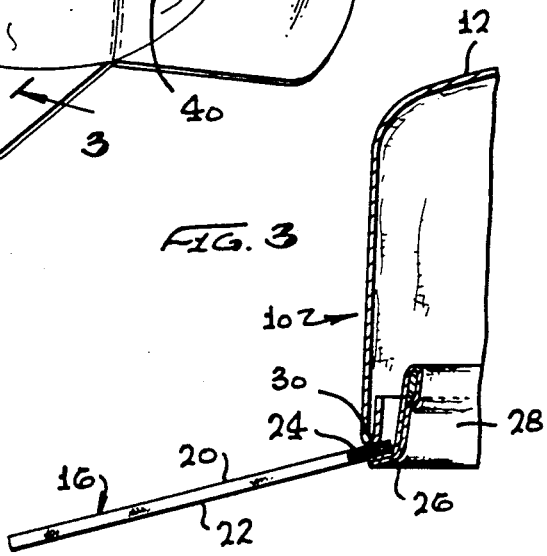
FIG. 5
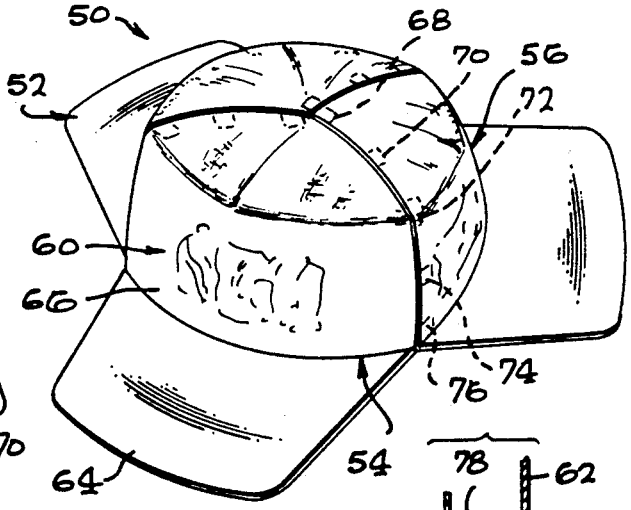
FIG. 4
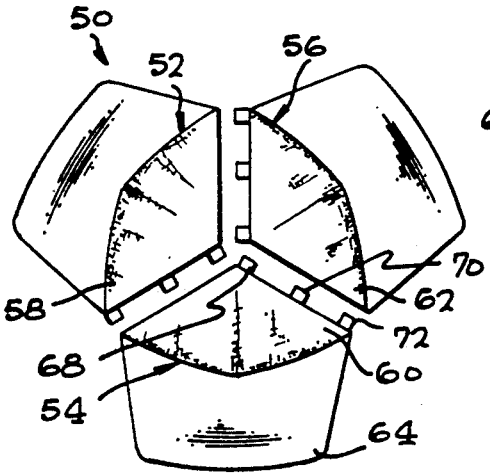
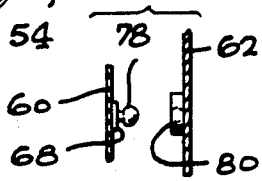
FIG. 6

THREE-WAY HAT

FIELD OF THE INVENTION

This invention is directed to head coverings, and particularly hats which have a display segment thereon to both provide a message and eye shading.

BACKGROUND OF THE INVENTION

Hats and caps having sports or other indicia are well known. In the more rural areas, the indicia relate to farm machinery and supplies. In the more urban areas, the indicia more likely relate to sports. In sporting goods shops and at stadium concession areas, hats or caps are available with the local team logo and name thereon. Most often, these are caps with a single bill and a team name over the bill on a portion of the crown directly above the bill. Often, the entire cap is in team colors.

For the sports fan who follows more than one sport, a plurality of such caps seems needed, one for each of "his" teams. Such single-billed caps are widely available.

SUMMARY OF THE INVENTION

In order to aid in the understanding of this invention, it can be stated in essentially summary form that it is directed to a multi-billed hat wherein the crown of the hat carries thereon in excess of two bills with a display segment on each bill and a unique message above each display segment.

It is thus an object and advantage of this invention to provide a hat which can display at the same time a plurality of unique vessels where they may be unique in color, wording, texture, or configuration to identify an organization.

It is a further object and advantage of this invention to provide a three-way hat which has three bills thereon and a unique message above each bill so that the hat may be worn with any one of the three bills over the face of the wearer to display at the front of the hat the message over that bill.

It is another object and advantage of this invention to provide three-way hat wherein a plurality of organizations can each carry its unit over one of the bills of the hat so that different organizations can be identified by placing that bill over the wearer's face.

It is a further object and advantage of this invention to provide a three-way hat wherein a sports fan can display on his hat at least three unique messages representing his favorite teams, with each of the messages corresponding in position to be over one of the bills of the hat.

The features, of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a perspective view of the first preferred embodiment of the hat of this invention.

FIG. 2 is a plan view thereof, on reduced scale.

FIG. 3 is a section of the hat of FIG. 1 taken on an enlarged scale, as seen generally along 3—3 of FIG. 1, with parts broken away.

FIG. 4 is a plan view, similar to FIG. 2, of the second preferred embodiment of the three-way hat of this invention.

FIG. 5 is a perspective view of the hat of FIG. 4, similar to FIG. 1.

FIG. 6 is an enlarged detail of the snap which holds the segments together of the segment hat shown in FIGS. 4 and 5.

DESCRIPTION OF THE PREFERRED EMBODIMENTS

The first preferred embodiment of the three-way hat of this invention is generally indicated at 10 in FIGS. 2 and 3. Hat 10 has a crown 12 which is principally made of fabric so that it is flexible and can be stretched to take on shape other than simple curves. The crown extends over and protects the head. Attached to the crown are three bills 14, 16 and 18. As seen in FIG. 3, a bill may be conveniently made with upper and lower fabric layers 20 and 22 with a stiff layer 24 therebetween. The stiff layer may be a sheet of flexible synthetic polymer composition material which has sufficient stiffness to hold the bill 16 in shape. Attachment of the bill to the crown may be conveniently accomplished by means of a sewn seam 26 which passes through headband 28, through the bill 16 adjacent the upper edge thereof and through the crown 12 adjacent the lower edge thereof. The crown 12 is folded at fold line 30, which is also the seam line. Each of the three bills is separately attached to the crown. The crown is preferably divided into three segments 32, 34, and 36, which are respectively above the bills 14, 16 and 18. The crown segments are preferably separate and sewn together along seam lines 38, 40 and 42. In order to provide good shape to the crown, each of the crown segments is also seamed at the top to give curvature. The crown defines three display segments. Display segments 44, 46 and 48 are respectively positioned above bills 14, 16 and 18. In the preferred embodiment, the display segments are integral portions of the crown, and the display segments are separated by the seam lines 38, 40 and 42. In this way, the display segments and the crowns may be of different fabric, texture and color than those of the other display segments and crown segments.

On the other hand, the crown may be made up of one type of fabric, and the display segments are applied thereto. In each case, the display segments correspond in width to the width of the bills. Three is the preferred number of bills and display segments, and, in the preferred embodiment, each takes up 120 degrees at the seam line 26. A larger number of display segments and corresponding bills is also within the scope of this invention, but when the number gets too many, the width of each bill becomes too narrow for its functional purpose of shading the eyes and faces.

Each of the display segments displays a unique message bearing differences in color, logo, wording, texture, or configuration to identify a particular group, usually a sporting group.

As best noted in FIG. 2, each of the bills occupies its full share of the circumference of the crown. That is to say, with the three bills shown in the preferred embodiment, each of the bills occupies a full 120 degrees where it joins the crown. If there were four bills, each would occupy 90 degrees of the circumference of the crown. The side edges of the bills are convergent as the bills extend away from the crown, and the front edges of the bills are portions of a circular curve which has its center at the center of the crown. In this way, a hat is configured where, when one bill is centered over the face, the other two bills are positioned over the ears and sides of the neck also to provide lateral shading of the wearer.

It can be appreciated that, three or more display segments are provided in the hat, there is a large number of combinations. If a large city has football, basketball, baseball, soccer and hockey and each such team has a unique message, then it can be appreciated that for a hat having three display segments there will be a large number of combinations. For this reason, the three-way hat may be configured so that the various segments are not permanently attached. The hat 50, shown in FIGS. 4 and 5, is the same as the hat 10 shown in FIGS. 1, 2, and 3, except that the joint between the segments is not permanently made, but is detachable. Again, the preferred embodiment of the hat 50 is with three segments 52, 54 and 56, but more segments may be provided, if desired. Each of the hat segments comprises a crown segment, a display segment, and a bill. Crown segments 58, 60 and 62 are particularly identified.

Hat segment 54 and crown segment 60 are shown in the foreground in FIGS. 4 and 5. They carry bill 64. The bill in each segment is the same and is the same as the bill 16. The bill is attached between a headband segment and the crown segment. Each of the crown segments has a display segment thereon, with the display segment 66 being particularly identified on crown segment 60 in FIG. 5. Each of the crown segments and each of the bills may have color texture corresponding to the unique message. Further elements of the unique message, such as a word message, logo, or symbol can be located on the display segment 60. Similarly, different unique messages are provided on the display segment of each of the crown segments, as discussed above.

Since there can be a wide selection of the hat segments carrying different unique messages, the wearer can select the three segments with the selected unique messages. The three segments are then attached together by means of tabs which overlap the segments and carry corresponding detachable snaps thereon. Tabs 68, 70, 72, 74, and 76 extend out from the right edge, as seen from the top in FIG. 4, of hat segment 54 and engage under and within the crown segment 62 of hat segment 56, see FIGS. 4 and 5. There are detachable snaps on the tabs and corresponding crown segments. As seen in FIG. 6, tab 68 has snap member 78 thereon which engages in female snap member 80 positioned under the edge of crown segment 62. Each of the other snaps is similar so that, when the snaps are all engaged, the three hat segments are secured together for wearing. At any time from first selection to later use, one of the segments can be removed, and another similar segment with a different unique message can be substituted. In this way, the wearer can wear a hat with a plurality of unique messages thereon and wear the hat so that any one of the messages is emphasized by being in the front.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A hat comprising:

a crown, said crown comprising a plurality of detachable crown segments, said plurality being greater than two;

a corresponding plurality of bills, each said bill permanently attached to a corresponding one of said crown segments; and a display segment on each said crown segment above each said bill, each said display segment displaying a unique message.

2. The hat of claim 1 wherein there are three said bills spaced around said crown and permanently attached to said crown and there are three corresponding display segments on said crown.

3. A hat comprising:

a crown, said crown being formed of at least three crown segments, said at least three crown segments being equal in size and being permanently attached to each other;

a display segment forming a portion of each said crown segment; and a bill attached to each said crown segment below said display segment thereon so that each said display segment can display a unique message.

4. The hat of claim 3 wherein each said crown segment is uniquely formed in accordance with the unique message positioned on its display segment.

5. The hat of claim 4 wherein each said bill is permanently attached to its corresponding crown segment.

6. The hat of claim 4 wherein each said bill occupies the full width of said crown segment at its attachment thereto so that said bills on said crown segment are directly adjacent each other at their attachments to their corresponding crown segments.

7. The hat of claim 6 wherein each said bill is permanently attached to its corresponding crown segment.

8. A hat comprising:

a plurality of crown segments, said plurality of crown segments being greater than two, each of said crown segments having a bill attached thereto, each of said crown segments having a display segment thereon and each of said crown segments having a unique message thereon, said crown segments being detachably attached together so that crown segments can be selected and attached to other crown segments to create a selected group of unique messages.

9. The hat of claim 8 wherein each said bill is substantially as wide as said crown segment at its attachment to said crown segment so that said bills substantially adjoin each other when said crown segments are joined together.

10. The hat of claim 8 wherein each said crown segment and its attached bill is unique in character and corresponds to the unique message on its display segment.

11. The hat of claim 10 wherein each said bill is permanently attached to its corresponding crown segment.

12. The hat of claim 11 wherein there are three said crown segments detachably attached together.

13. The hat of claim 8 wherein there are three said crown segments detachably attached together.

* * * * *